US006352433B2

(12) United States Patent
Hayashi

(10) Patent No.: US 6,352,433 B2
(45) Date of Patent: Mar. 5, 2002

(54) INSTRUMENT PANEL MOUNTING STRUCTURE

(75) Inventor: Hiroyuki Hayashi, Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/391,235

(22) Filed: Sep. 7, 1999

(30) Foreign Application Priority Data

Dec. 28, 1998 (JP) ..... 10-374155

(51) Int. Cl.[7] ..... H01R 33/74

(52) U.S. Cl. ..... 439/34; 439/364

(58) Field of Search ..... 439/34, 296, 246, 439/247, 248, 157

(56) References Cited

U.S. PATENT DOCUMENTS 4,954,085 A * 9/1990 Inoue et al. ..... 439/34
5,975,928 A * 11/1999 Tsuji ..... 439/157

* cited by examiner

*Primary Examiner*—P. Austin Bradley
*Assistant Examiner*—Alexander Gilman
(74) *Attorney, Agent, or Firm*—Oliff & Berridge, PLC

(57) ABSTRACT

A second connector (15) on an engine control unit (10)side is directly fixed to the engine control unit (10) and the engine control unit (10) is fixed in the interior of the equipment box (4) in such manner that it finely moves therein. A first connector (25) on an instrument panel (20) side is gradually moved up in a vertical direction, while being faced to the second connector (15) on the engine control unit (10) side for connection of the fist connector (25) and the second connector (15) Lever-type connectors are used as the first and second connectors (25) and (15) which have a function to reduce a load resulting at the time of connection of the connectors.

8 Claims, 7 Drawing Sheets

INSTRUMENT PANEL MOUNTING STRUCTURE

BACKGROUND OF THE INVENTION

1. Field of the Invention

The present invention relates to an instrument panel mounting structure in which an instrument panel of an automobile is mounted on a partition wall that separates an engine compartment from a passenger compartment of a vehicle body.

2. Description of the Related Art

A conventional instrument panel mounting structure is shown in FIG. 5 in which an instrument panel is mounted on a partition wall separating an engine compartment from a passenger compartment.

An equipment box 4 is provided on a partition wall 3 separating an engine compartment 1 from a passenger compartment 2 of an automobile, and an engine control unit 10 is accommodated therein for controlling an engine. A plurality of female connectors 12*a* to 12*c* are secured to the engine control unit 10 via a wiring harness.

An opening 4*a* is formed in a bottom of the equipment box 4 for allowing the connectors 12*a* to 12*c* to be pulled into the passenger compartment 2. In addition, the equipment box 4 is designed to be given an interior space larger than the engine control unit 10 so as to accommodate therein the female connectors 12*a* to 12*c* and male connectors 22*a* to 22*c* on an instrument panel 20 side, which will be described later, together with the associated wiring harness 11 after those connector are connected to each other, respectively.

Provided on an instrument panel 20 are a connector mounting portion 21 to which the male connectors 22*a* to 22*c* are fixed and an instrument panel fixing portion 23 at which the instrument panel 20 is fixed to the vehicle body.

In general, a connector secures an electrical connection when a male terminal is press fitted in a female terminal. Due to this, the number of pins is limited to that which allows connectors to manually be connected to each other. Thus, as shown in FIG. 5, the leading end of the wiring harness 11 is divided into a plurality portions so that a plurality of connectors 12*a* to 12*c*, 22*a* to 22*c* are used to satisfy required connections.

Next, shown in FIG. 6A, FIG. 6B and FIG. 6C are a conventional instrument panel mounting procedure. FIG. 6A shows a state in which the engine control unit 10 is mounted in the equipment box 4 and in this state, a pre-process is completed for a mounting process of an instrument panel. FIG. 6B shows a state in which the female connectors 12*a* to 12*c* on the engine control unit 10 side are connected to the male connectors 22*a* to 22*c* on the instrument panel 20 side, respectively. FIG. 6C shows a state in which mounting of the instrument panel 20 is completed.

In mounting the instrument panel 20 on the partition wall 3, a worker starts from the state shown in FIG. 6A and opens a lid 4*b* to the equipment box 4 from the engine compartment side so that the female connectors 12*a* to 12*c* are allowed to suspend from the opening 4*a* in the bottom of the equipment box 4 into the passenger compartment 2 side. Next, as shown in FIG. 6B, with the instrument panel 20 being retained with a jig, the female connectors 12*a* to 12*c* are connected to the male connectors 22*a* to 22*c*, respectively. Moreover, the instrument panel 20 is positioned relative to the partition wall 3 while pushing the wiring harness 11 and the then connected connectors 12*a* to 12*c* and 22*a* to 22*c*, and then as shown in FIG. 6C, the instrument panel 20 is fixed with bolts 24 to the partition wall 3 or any other suitable position on the vehicle body at the instrument panel fixing portion 23.

According to the aforesaid conventional instrument panel mounting structure, however, the female connectors 12*a* to 12*c* on the engine control unit 10 side have to manually be connected to the male connectors 22*a* to 22*c* on the instrument panel 20 side. In view of work involved in a narrow space such as inside a cockpit of an automobile, this leads to a drawback in that a very difficult mounting operation is required.

In addition, provided on the instrument panel 20 are equipment directly relating to driving of an automobile such as a speedometer and a fuel gauge, and other equipment such as an air conditioner, audio equipment, a GPS car navigation system, and air bags. This tends to increase the number of circuits required. In conjunction with increase in number of connectors, there is increasingly caused a risk of erroneous connections, and failures to or of connection.

Furthermore, since the equipment box 4 is designed to accommodate therein the connected connectors 12*a* to 12*c*, 22*a* to 22*c* and the associated wiring harness 11, with increase in number of connectors, the equipment box 4 also has to be made larger, this leading to a drawback in that the equipment box 4 shares a larger space inside the engine compartment 1.

SUMMARY OF THE INVENTION

The present invention was made to solve the aforesaid problems inherent in the prior art and an object thereof is to provide an instrument panel mounting structure that can allow an increase in number of connectors without any increase in size of an equipment box, which can effect easy and secure connections between connectors on the engine control unit side and connectors on the instrument panel side, and which can allow an instrument panel to be mounted on a partition wall separating an engine compartment from a passenger compartment in an extremely easy fashion.

With a view to attaining the above object, the present invention provides an instrument panel mounting structure in which an instrument panel including at least a first connector is mounted on a partition wall which separates an engine compartment from a passenger compartment while said first connector is being connected to a second connector of an engine control unit fixed to said partition wall, wherein in a case where with the second connector being fixed to the engine control unit, the instrument panel is mounted on the partition wall, the engine control unit is fixed to the partition wall such that the second connector faces the first connector on an instrument panel side and is located at a position allowing the second connector to be connected to said first connector, whereby positioning and temporary fixation of the instrument panel relative to the partition wall is effected by connecting the first connector to the second connector.

In the above construction, the engine control unit may be allowed to finely move so that the second connector can finely move in transverse and longitudinal directions.

In addition, lever-type connectors may be used as the first and second connectors in which a swivel lever having an engagement portion is provided on one of the lever-type connectors, while a boss adapted to engage the engagement portion of the swivel lever is provided on the other.

Furthermore, male threads may be provided in the first connector, while female threads may be provided in the second connector for thread engagement with the male threads.

The present disclosure relates to the subject matter contained in Japanese patent application No. Hei. 10-374155 (filed on Dec. 28, 1998) which is expressly incorporated herein by reference in its entirely.

DETAILED DESCRIPTION OF THE PREFERRED EMBODIMENTS

Figure 1:
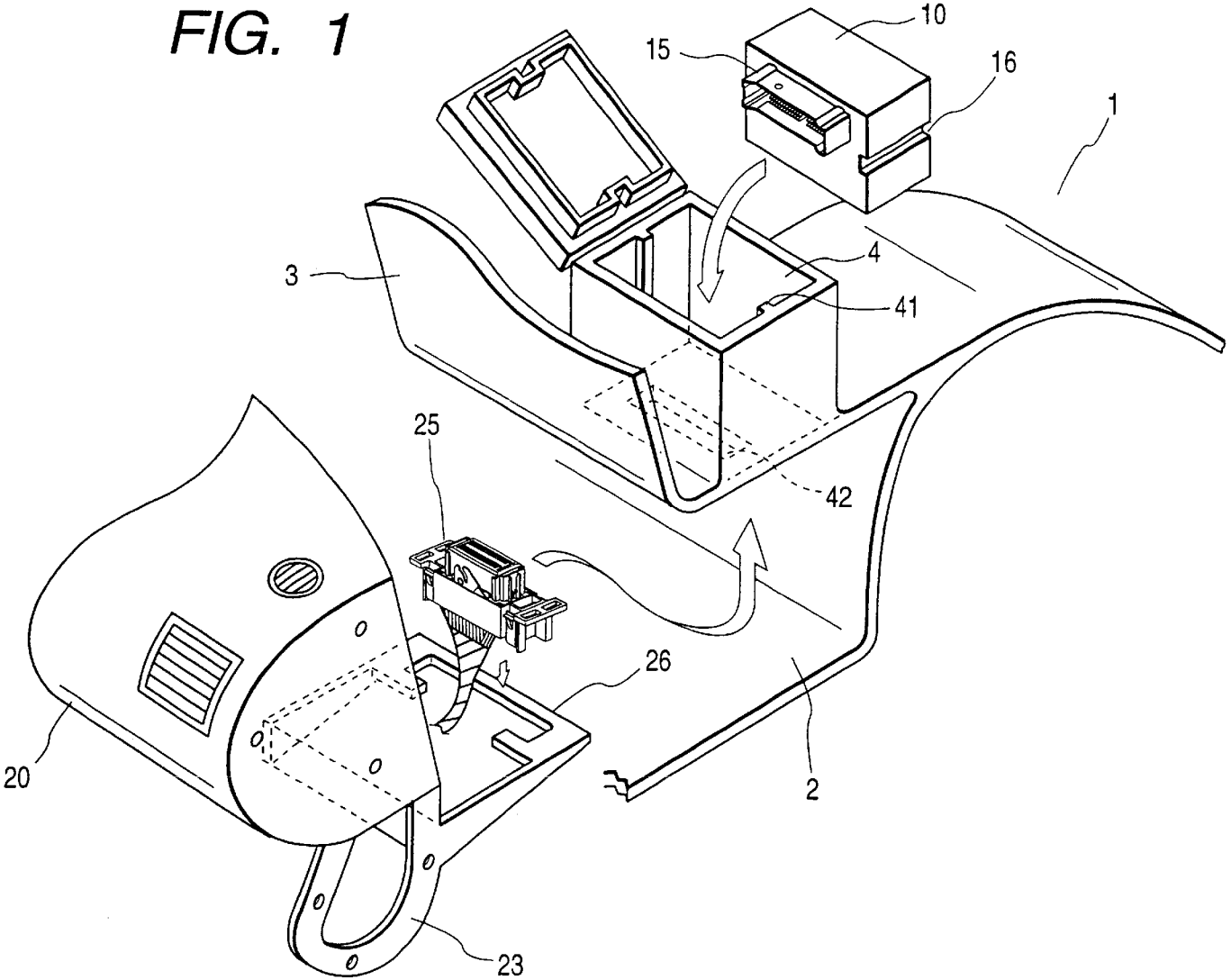
FIG. 1 is a perspective view showing a construction of a mode of operation of an instrument panel mounting structure of the present invention.

Described below will be a mode of operation of an instrument panel mounting structure according to the present invention. First of all, an instrument panel mounting structure according to the present invention is shown in FIG. 1.

A connector (second connector) 15 on an engine control unit side is directly connected to an engine control unit 10. A groove 16 is formed in a side wall of the engine control unit 10 for positioning the engine control unit 10 within the interior of an equipment box 4.

The equipment box 4 provided on a partition wall 3 separating an engine compartment 1 from a passenger compartment 2 of an automobile is given an interior space sufficient for accommodation of the engine control unit 10 for controlling the engine therein, but it is not given an additional space for accommodating therein connected connectors and their associated wiring harness as given with the conventional example. A projection 41 is formed on a side wall of the equipment box 4 for engagement in the groove 16 formed in the side wall of the engine control unit 10. In addition, an opening 42 is formed in a bottom of the equipment box 4 so that the second connector 15 is allowed to project into the passenger compartment 2. It is desirable that the engine control unit 10 is adapted to finely move within the interior of the equipment box 4 so as to compensate for relative positional errors between a first connector 25 on an instrument panel side, which will be described later, and the second connector on the engine control unit side.

Provided on an instrument panel 20 are a connector mounting portion 26 to which the first connector 25 is fixed and an instrument panel fixing portion 23 at which the instrument panel is fixed to the vehicle body.

Figure 2A:
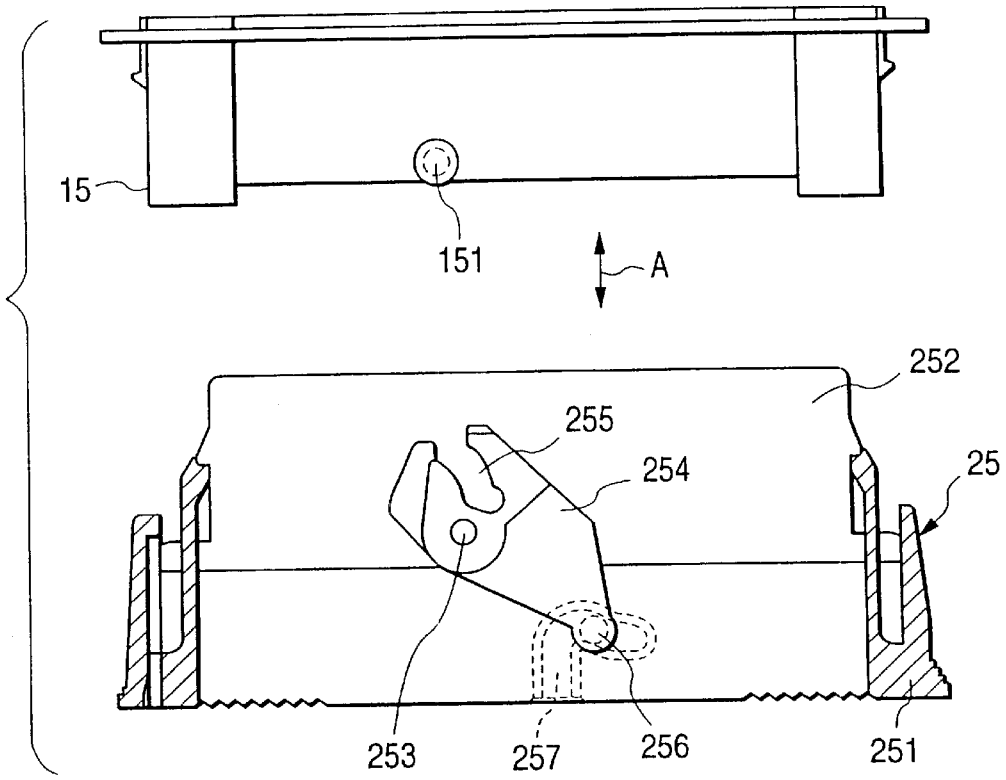
FIG. 2A and FIG. 2B are views showing constructions of first and second connectors for use for the above mode of operation and a state in which the connectors are connected to each other.
Figure 2B:
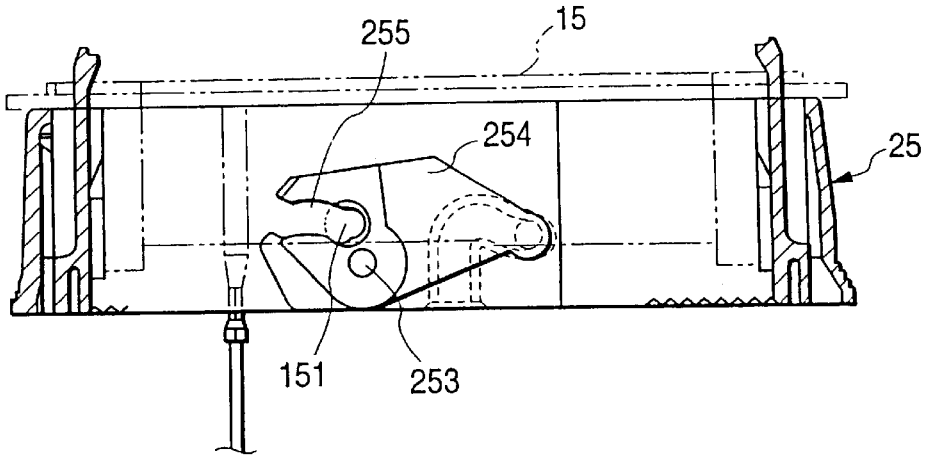
Figure 3:
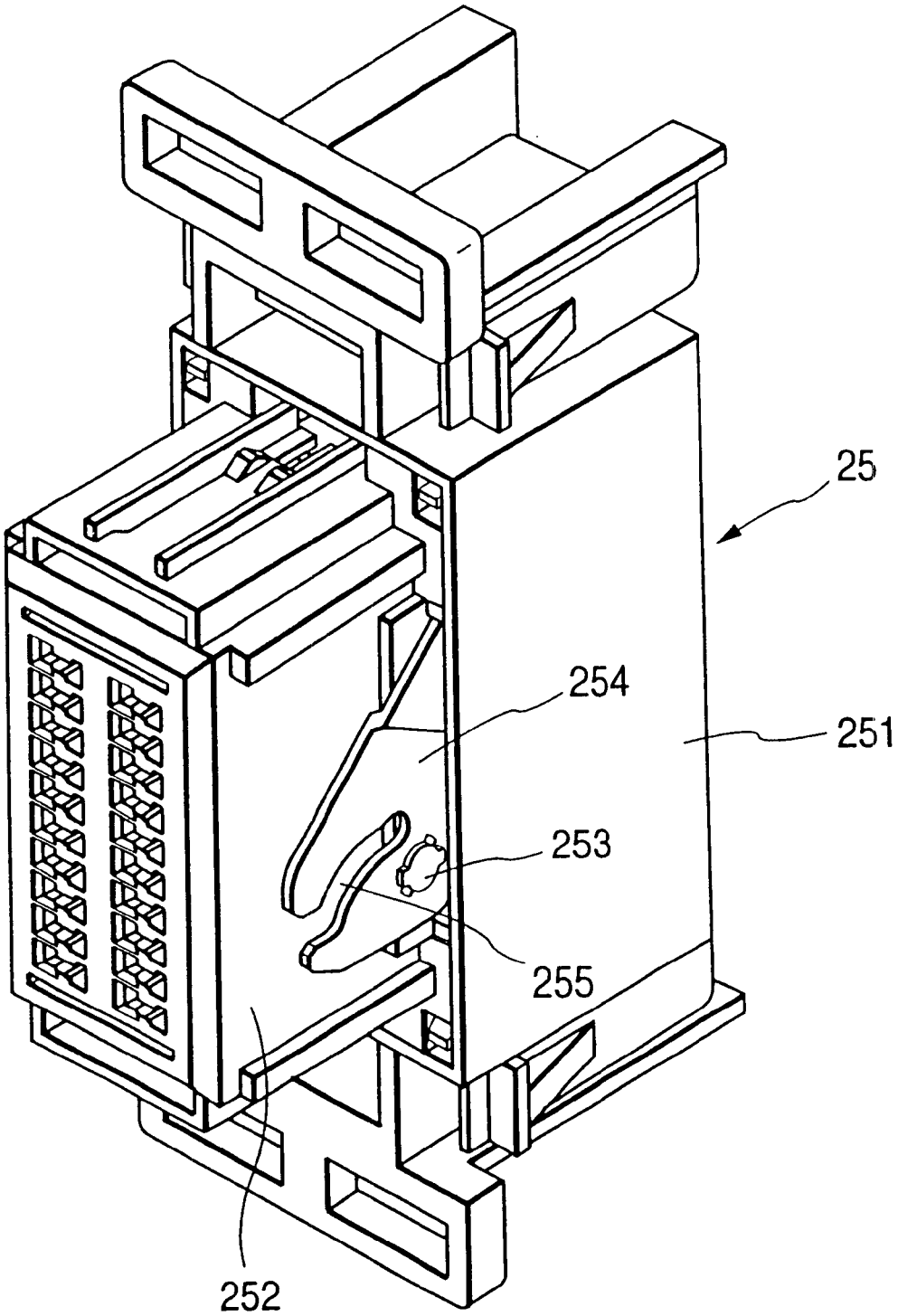
FIG. 3 is a perspective view showing an external appearance of the first connector for use with the above mode of operation.

Next, FIG. 2A and FIG. 2B show construction of the first connector 25 and the second connector 15 that are used in the mode of operation, as well as a connecting operation of those connectors. In FIG. 2A, FIG. 2A shows a state in which the first connector 25 and the second connector 15 are not yet connected to each other. FIG. 2B shows a state in which the first connector 25 and the second connector 15 are connected to each other. FIG. 3 shows an external appearance of the first connector 25.

For instance, let's assume that the first connector 25 is a female connector, the second connector 15 being a male connector. Female terminals are arranged inside the first connector 25 which are connected to electric wires from equipment provided in the instrument panel 20 such as those directly related to driving of an automobile such as a speedometer and a fuel gauge and others such as an air conditioner, audio equipment, a GPS car navigation system and air bags.

As shown in the respective views, the first connector 25 is constituted by a stationary portion 251 that is connected to the connector fixing portion 26 of the instrument panel 20 and a movable portion 252 which is slidable relative to the stationary portion 251 in a direction indicated by arrow A. A swivel lever 254 is provided on the movable portion 251 which is adapted to swivel about a shaft 253. The swivel lever 254 has an engagement groove 255 for engagement with a boss 151 provided on the second connector 15 and a boss 256 adapted to fit in a guide groove 257 formed in the stationary portion 251.

As is described previously, a connector secures an electrical connection between a male terminal and a female terminal trough press fitment of the male and female connectors. Due to this, with a large number of pins in a connector, a tremendous magnitude of force is required to effect a connection between the first connector 25 and the second connector 15. On the other hand, it is difficult to make the first connector 25 translate in parallel relative to the second connector 15. In these conditions, if the connectors are tried to be connected to each other with a large magnitude of force, the first connector 25 becomes inclined relative to the second connector 15, resulting in a failure of the male or female connector. As will be described later, however, the swivel lever 254 and the boss 151 function as a mechanism for reducing loads resulting at the time of connection of the connectors, and they allow the first connector 25 and the second connector to be connected to each other with a relatively small magnitude of force. Also, with the swivel lever and the boss, the first connector 25 can be translated in parallel with the second connector 15. Thus, there can be eliminated a risk of failure of the male or female connector.

When trying to connect the first connector 25 with the second connector 15, the female terminals in the first connector 25 come into contact with male terminals in the second connector 15, and the female terminals then stop their movement when they are half fitted over the male terminals. At this time, the boss 151 of the second connector 15 is in engagement with the engagement groove 255 in the swivel lever 254 provided on the movable portion 252 of the first connector 25. When the first connector 25 is pushed further toward the second connector 15, the movable portion 252 of the first connector 25 is then moved, and in conjunction with this, the swivel lever 254 swivels about the shaft 253 thereof. Swiveling of the swivel lever 254 makes the boss 151 of the second connector 15 slide along the engagement groove 255 of the swivel lever 254, while the boss 256 of the swivel lever 254 also slides along the guide groove 257. The first connector 25 and the second connector 15 have not yet been connected to each other completely even after the aforesaid operations have been completed. In this state, the boss 151 of the second connector 15 and the engagement portion 255 of the swivel lever 254 follow the movement of the movable portion 251 of the first connector 25 or the boss 151 pushes an end face of the engagement portion 255.

Moreover, when the first connector 25 is pushed further toward the second connector 15, the boss 256 of the swivel lever 254 reaches an terminating end portion of the guide groove 257, and no more movement is allowed thereafter. When the first connector 25 is pushed further from this state, the end face of the engagement portion 255 of the swivel lever 254 pushes the boss 151 of the second connector 15 toward the first connector 25, whereby the swivel lever 254 functions to pull in the second connector 15 toward the first connector 25 side. In other words, a force larger in magnitude than the force being actually applied to the first connector 25 is applied to both the first connector 25 and the second connector 15, whereby the male terminals in the second connector 15 are then press fitted in the female terminals of the first connector 25. Thus, with a relatively small magnitude of force, the first connector 25 and the second connector 15 can be connected to each other.

As is described above, with the lever-type connectors being used as the first connector 25 and the second connector 15, even when there are a large number of pins provided in the connector, resulting in a large magnitude of load required at the time of connection of the connectors, the first connector 25 and the second connector 15 can be connected to each other with a relatively small magnitude of force by virtue of the operation of the swivel lever 254. In addition, the instrument panel 20 is positioned in place relative to the partition wall 30 at the same time the first connector 25 is connected to the second connector 15. Once the positioning of the instrument panel is completed, mounting of the instrument panel 20 is completed when the instrument panel fixing portion 23 is fixed with the bolts to the partition wall 3 or any other suitable location of the vehicle body.

Figure 4A:
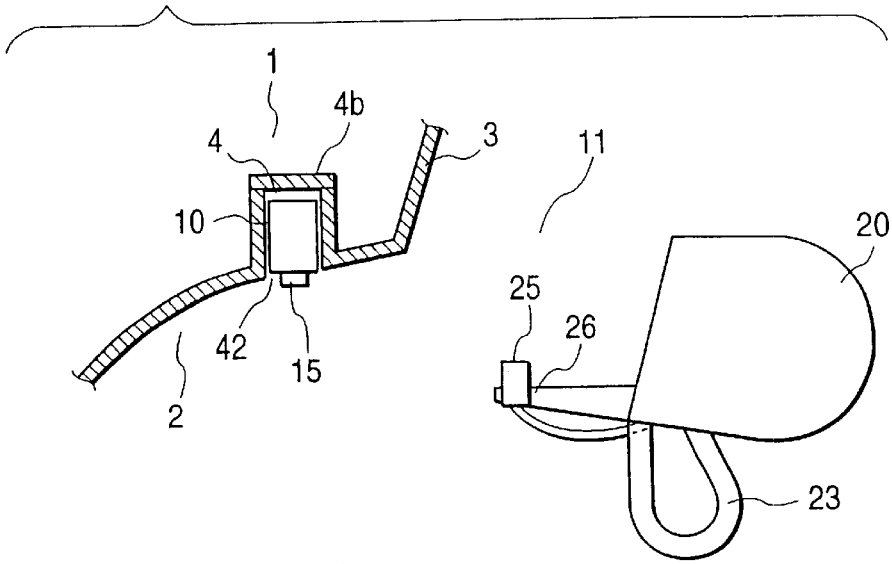
FIG. 4A, FIG. 4B and FIG. 4C are views showing an instrument panel mounting procedure in the above mode of operation.
Figure 4B:
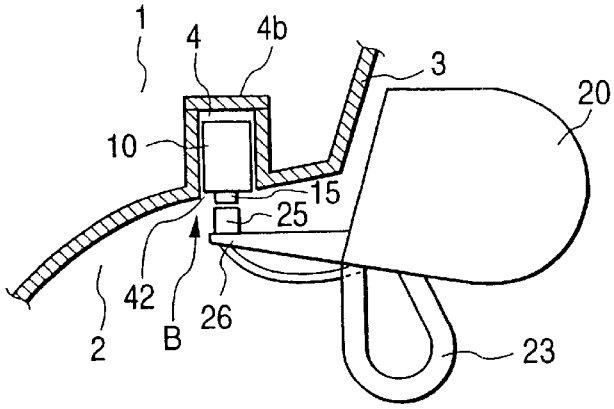
Figure 4C:
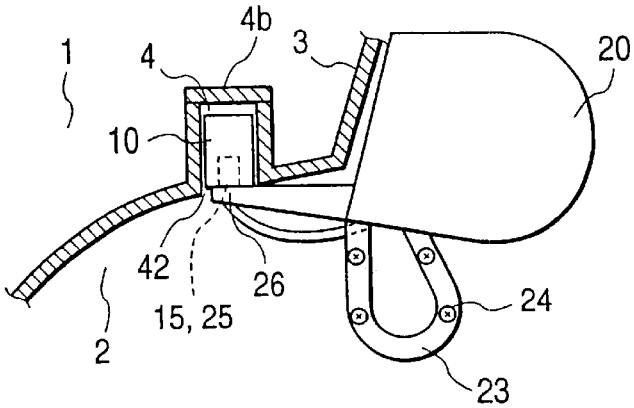
Figure 5:
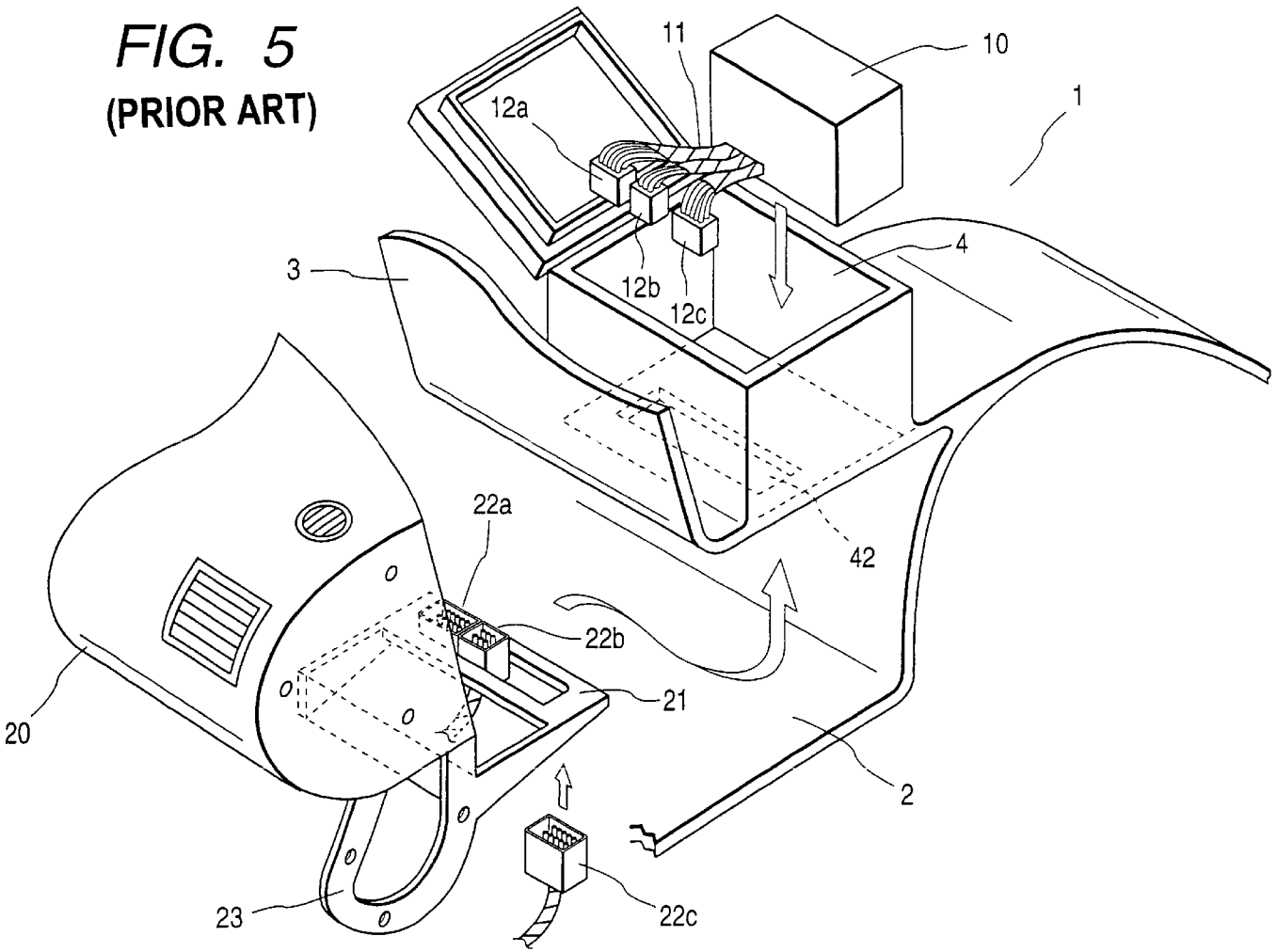
FIG. 5 (PRIOR ART)
FIG. 5 is a perspective view of a conventional instrument panel mounting structure.
Figure 6A:
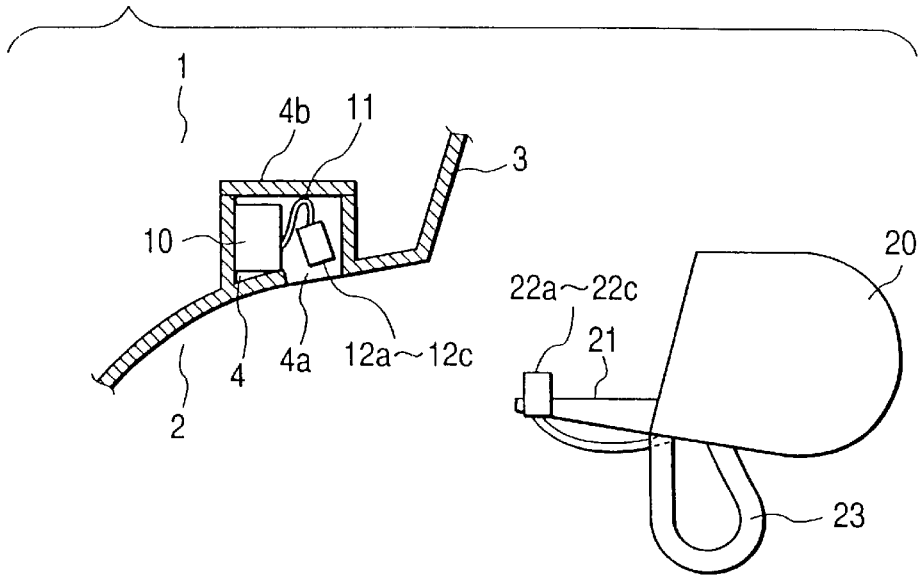
FIG. 6A (PRIOR ART)
FIG. 6A, FIG. 6B and FIG. 6C are views showing a conventional instrument panel mounting procedure.
Figure 6B:
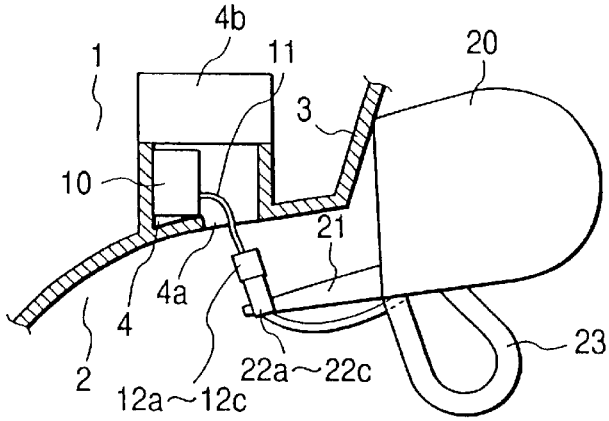
FIG. 6B (PRIOR ART)
Figure 6C:
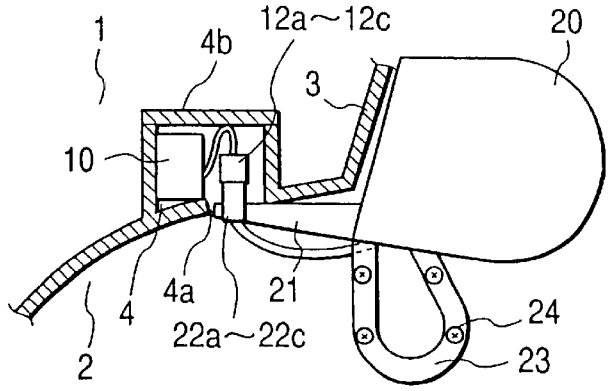
FIG. 6C (PRIOR ART)

Next, an instrument panel mounting procedure according to the present invention is shown in FIG. 4A, FIG. 4B and FIG. 4C. FIG. 4A shows a state in which the engine control unit 10 is mounted in the equipment box 4, and this completes a pre-process for an instrument panel 20 mounting process. FIG. 4B shows a state in which the second connector 15 on the engine control unit 10 side and the first connector 25 on the instrument panel 20 side are being connected to-each other. FIG. 4C shows a state in which mounting of the instrument panel 20 is completed.

As shown in FIG. 4A, in this mode of operation, the second connector 15 on the engine control unit 10 side is directly fixed to the engine control unit 10, which is mounted in the equipment box 4 such that the second connector 15 protrudes into the passenger compartment. Thus, as is the case with the prior art example, there is no need to open the lid 4*b* of the equipment box 4 from the engine compartment side so that the connectors can suspend from the opening 42 in the bottom of the equipment box 4.

Next, as shown in FIG. 4B, the instrument panel 20 is retained with a jig or the like such that the first connector 25 on the instrument panel 20 side faces the second connector 15 on the engine control unit 10 side which protrudes into the passenger compartment 2, and from that state, the instrument panel is gradually raised in a vertical direction as indicated by arrow B. As a result of this, the first connector 25 and the second connector 15 are connected to each other. In addition, with a simple lock mechanism such as a locking pawl being provided between the first connector 25 and the second connector 15, the first connector 25 and the second connector 15 are locked to each other when they are connected. Thus, the first connector 25 and the second connector 15 can be used as a positioning mechanism for positioning the instrument panel 20 relative to the partition wall 3.

When the instrument panel 20 is positioned relative to the partition wall 3, as shown in FIG. 4C, the instrument panel fixing portion 23 is fixed with the bolts 24 to the partition wall 3 or any other suitable location on the vehicle body, this completing the mounting process of the instrument panel.

In the above mode of operation of the present invention, although the lever-type connector is used as a connector, but the present invention is not limited thereto. Any connector may be used which has a suitable construction which can reduce a load resulting at the time of connection of connectors. For instance, instead of the lever-type connector, a thread connection-type connector may be used. Specifically, a screw thread is rotatably provided substantially at a central portion of the first connector 25 in such a manner that it does not come off the first connector 25, while female threads are formed substantially in a central portion of the second connector 15 for thread engagement with the screw thread.

In the case with the thread connection-type connector, avoiding to apply a large magnitude of force at one time, the screw thread is rotated with a relatively small magnitude of force in a continuous fashion, so that the first connector 25 is made to gradually approach the second connector 15 in response to the rotation of the screw thread for final connection of the first connector 25 with the second connector 15. Due to this, even when there are a large number of pins provided in the connectors, resulting in a large magnitude of load required for connection of such connectors, the connectors can be connected to each other with a relatively small magnitude of force. In addition, since a powered or electric screw driver can be used, the load of the worker can also be reduced.

Furthermore, when a connector is used which has a small number of pins and hence needs only a small magnitude of load for connection, then a normal connector may be used such as one described in the prior art example.

As has been described heretofore, with the instrument panel mounting structure according to the present invention in which an instrument panel including at least a first connector is mounted on a partition wall which separates an engine compartment from a passenger compartment while said first connector is being connected to a second connector of an engine control unit fixed to said partition wall, wherein in a case where with the second connector being fixed to the engine control unit, the instrument panel is mounted on the partition wall, the engine control unit is fixed to the partition wall such that the second connector faces the first connector on an instrument panel side and is located at a position allowing the second connector to be connected to said first connector, whereby positioning and temporary fixation of the instrument panel relative to the partition wall is effected by connecting the first connector to the second connector, the first and second connectors function as a positioning jig and a temporary fixation jig, and the instrument panel is temporarily fixed to the partition wall separating the engine compartment from the passenger compartment of the vehicle body at the same time when the connectors are connected to each other, this simplifying the instrument panel mounting operation. In addition, since the second connector on the engine control unit side is fixed in advance, there needs no operation of pushing a wiring harness in to the equipment box, this reducing the load experienced by the worker when the instrument panel is mounted.

In addition, the engine control unit is allowed to finely move so that the second connector can finely move in transverse and longitudinal directions, whereby a relative positional error can be compensated for which occurs between the first connector on the instrument panel side and the second connector on the engine control unit side.

In addition, the lever-type connectors may be used as the first and second connectors in which the swivel lever having the engagement portion is provided on one of the lever-type connectors, while the boss adapted to engage the engagement portion of the swivel lever is provided on the other, whereby the first and second connectors can be connected to each other with a relatively small magnitude of force even when there are a large number of pins provided in the connectors, resulting a large magnitude of load required for connection of such connectors.

Figure 7:
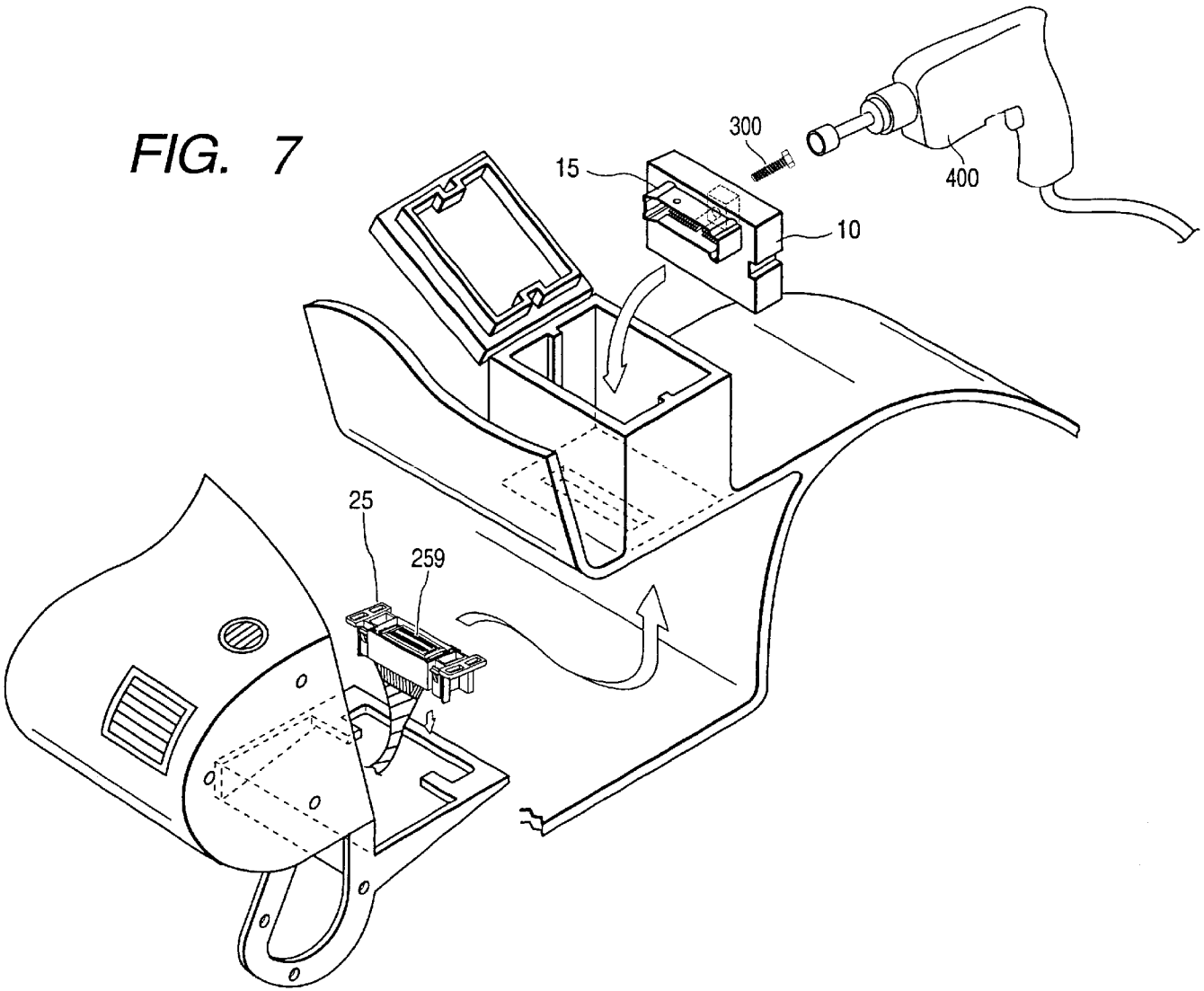
FIG. 7 is a perspective view showing a threaded connection between first and second connectors of an instrument panel mounting structure of the present invention.

Furthermore, as shown in FIG. 7 male threads or a screw thread 300 may be provided in the first connector, while female threads 259 may be provided in the second connector for thread engagement with the male threads. In this construction, even when there are a large number of pins provided in the connectors, resulting a large magnitude of load required for connection of such connectors, the first and second connectors can be connected to each other with a relatively small magnitude of force by putting the male threads 300 and the female threads 259 into gradual thread engagement. In addition, a powered or electric screw driver 400 can be used, so that the load can be reduced which is experienced by the worker when the instrument panel is mounted.

What is claimed is:

1. An instrument panel mounting apparatus comprising:

an instrument panel having a first connector fixed thereto, a partition wall that separates an engine compartment from a passenger compartment, an engine control unit fixed to the partition wall, and a second connector fixed to the engine control unit and thereby being fixed relative to the partition wall, the second connector being matable with the first connector, wherein, when said first connector is mated with said second connector, said first and second connectors temporarily hold said instrument panel in substantially a final assembly position relative to said partition wall.

2. An instrument panel mounting apparatus as claimed in claim 1, wherein said engine control unit is allowed to finely move so that said second connector can finely move in transverse and longitudinal directions.

3. An instrument panel mounting apparatus as claimed in claim 1, wherein lever-type connectors are provided as said first and second connectors in which a swivel lever having a first engagement portion is provided on one of said lever-type connectors, while a second engagement portion that engages said first engagement portion of said swivel lever is provided on the other.

4. An instrument panel mounting apparatus as claimed in claim 1, wherein male threads are provided in one of said first connector and said second connector, while female threads are provided in another one of said first connector and said second connector, said male and female threads threadedly engaging with each other.

5. An instrument panel mounting apparatus as claimed in claim 3, wherein one of said first connector and said second connector comprises a first portion and a second portion that is moveable relative to the first portion in a connection direction of the first and second connectors;

the swivel lever has a third engagement portion; and one of said first portion and said second portion includes a fourth engagement portion that engages said third engagement portion of the swivel lever, whereby, when said swivel lever is pivoted about an axis to draw said first and second connectors together, said first and second portions are moved relative to each other in the connection direction.

6. An instrument panel mounting apparatus according to claim 1, further comprising at least one fastener that fastens the instrument panel to a vehicle body, to permanently hold the instrument panel in the final assembly position.

7. An instrument panel mounting apparatus according to claim 6, wherein the instrument panel further comprises an instrument panel fixing portion, and the at least one fastener fastens the instrument panel via the instrument panel fixing portion.

8. An instrument panel mounting apparatus according to claim 1, wherein the instrument panel fixing portion is at a location separate from the first connector.

* * * * *